United States Patent [19]

Jackson

[11] 4,106,757

[45] Aug. 15, 1978

[54] HOVER FURNACES

[75] Inventor: George Jackson, Sheffield, England

[73] Assignee: British Steel Corporation, London, England

[21] Appl. No.: 765,767

[22] Filed: Feb. 4, 1977

[30] Foreign Application Priority Data

Feb. 17, 1976 [GB] United Kingdom ..... 6188/76

[51] Int. Cl.[2] ..... C21D 9/54

[52] U.S. Cl. ..... 266/103; 65/182 A; 432/8

[58] Field of Search ..... 34/156; 65/25 A, 182 A; 226/7, 95, 97; 266/103, 110, 111; 302/29; 432/8

[56] References Cited

U.S. PATENT DOCUMENTS 3,048,383 8/1962 Chomplin .....266/103

*Primary Examiner*—Roy Lake
*Assistant Examiner*—Paul A. Bell
*Attorney, Agent, or Firm*—Bacon & Thomas

[57] ABSTRACT

A furnace for continuously heat treating metallic strip comprises a substantially flat horizontal entry floatation table having a trailing portion which inclines downwardly towards the base of a floatation trough. The trough extends along substantially the full length of the heating zone furnace. An exit table includes a leading portion which inclines upwardly from the base of the trough to a generally horizontal flat floatation surface. Entry and exit seals are positioned above the entry and exit tables respectively.

9 Claims, 8 Drawing Figures

HOVER FURNACES

This invention relates to furnaces for continuously heat treating metal or ore aggregate in strip or sheet form (hereinafter referred to simply as metallic strip). More especially the invention relates to heat treatment furnaces in which metallic strip is transported through the furnace on a gaseous cushion.

Previous proposals for heat treatment furnaces incorporating a gaseous support system for metallic strip have had limited application because of their reliance upon large volumes of high pressure, high temperature gas from an external source or their inability to treat strips of different widths without consequent high gas losses to the atmosphere.

Furnaces are known in which strip is supported in a non-contact floating manner by a static pressure cushion formed by a multiplicity of high pressure gas jets supplied from a gas source external of the furnace. Such a furnace is expensive to run because of the continued need to supply to it large volumes of gas to maintain the support cushion.

Furnaces are also known which include a hearth in the form of a trough having outwardly sloping walls, gas being supplied to the lower region of the trough to form a support cushion below the strip passing through the trough. Such furnaces have the advantage over the previously discussed furnaces in that relatively low volumes of gas are required to maintain the support cushion, that the strip is self-centering as it passes through the furnace and that a greater variety of strip widths can be accepted by the furnace. They suffer, however, from the disadvantages that the strip, whilst in the furnace trough, adopts a bowed configuration and that strips of different widths float through the trough at different heights. Thus unless complicated and expensive seals are provided at entry to and exit from the furnace, gas losses to the atmosphere will be excessive since the depth of these openings has to be sufficiently large to permit the strip to pass through in the bowed configuration which it adopts as it floats through the trough and to enable strips at different heights within the trough to enter and leave the furnace.

The present invention provides a furnace which overcomes these disadvantages.

According to the present invention there is provided a furnace for continuously heat treating metallic strip which comprises an entry table including a leading portion having a substantially plane upper surface and a trailing portion which inclines downwardly towards the base of a floatation trough, the trough extending along substantially the full length of the heating zone of the furnace and including upwardly and outwardly inclined side walls, the furnace also comprising flow restricting means located above the upper surface of the leading portion of the entry table to define with the table surface a shallow slot sufficient to enable strip to enter the furnace.

The entry table may comprise a floatation table having an upper surface provided with a plurality of orifices for discharging gas under pressure upwarly towards the under surface of the strip as it passes over the table. Alternatively, the entry table may comprise a roller table which includes a plurality of adjacent rollers which rotate about axes perpendicular to the direction of travel of the strip over the table.

According to the present invention in another aspect there is provided a furnace for continuously heat treating metallic strip which comprises an entry floatation table having an upper surface provided with a plurality of orifices for discharging gas under pressure upwardly towards the under surface of the strip as it passes over the table and including a leading portion having a substantially plane upper surface and a trailing portion which inclines downwardly towards the base of a floatation trough extending along substantially the full length of the heating zone of the furnace and including upwardly and outwardly inclined side walls, the furnace also comprising flow restricting means located above the upper surface of the leading portion of the entry floatation table and defining with the table surface a shallow slot sufficient to enable strip to enter the furnace.

Preferably, the furnace also comprises an exit floatation table having an upper surface provided with orifices for discharging gas under pressure upwardly towards the under surface of the strip as it passes over the table and including a leading portion which inclines upwardly from the base of the trough and merges with a substantially horizontal trailing portion of the table; flow restricting means is located above the trailing portion of the exit table and defines with the table surface a shallow slot sufficient to enable strip to pass out from the furnace.

The flow restricting means may comprise lip seals located one at entry to and one at exit from the furnace. Alternatively, the flow restricting means located at exit from the furnace may comprise a roller seal.

In a preferred furnace construction, the gas supplied to the trough of the furnace consists of a reducing gas, that supplied to the inclined portions of the entry and exit floatation tables consists of an inert gas and that supplied to those portions of the entry and exit floatation tables located respectively upstream and downstream of the flow restricting means comprises air under pressure.

The invention will now be described by way of example with reference to the accompanying diagrammatic drawings in which.

Figure 3:
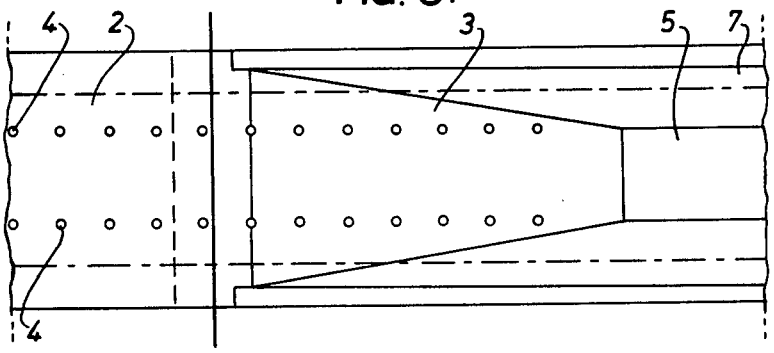
FIG. 3 is a plan view of the table illustrated in FIG. 2.

The furnace illustrated in the drawings includes an entry floatation or jet table 1 having a plane surfaced horizontal leading portion 2 and a downwardly inclined trailing portion 3. As will be seen from FIG. 3, the surface of the entry table 1 is provided with a plurality of evenly spaced orifices 4. The table portion 3 inclines downwardly towards the base 5 of a floatation trough 6 which extends along substantially the full length of the heating zone of the furnace. The side walls 7 of the trough are inclined upwardly and outwardly from the base 5 to the level of the leading portion 2 of the table 1 and the trailing portion 3 of the table is shaped to merge with the inclined side walls 7 of the trough. At the point of transition between the leading and trailing table portions 2 and 3 respectively, the table surface is curved. The trailing portion 3 may either be substantially flat or curved with substantially the same radius of curvature as that of transition between the two portions of the table. The furnace also includes an exit floatation or jet table 8 comprising a leading portion 9 inclined upwardly from the base 5 of the trough 6 to meet a generally flat horizontal trailing portion 11. The table 8 has formed in its surface a plurality of orifices similar to orifices 4 of table 1.

Figure 1:
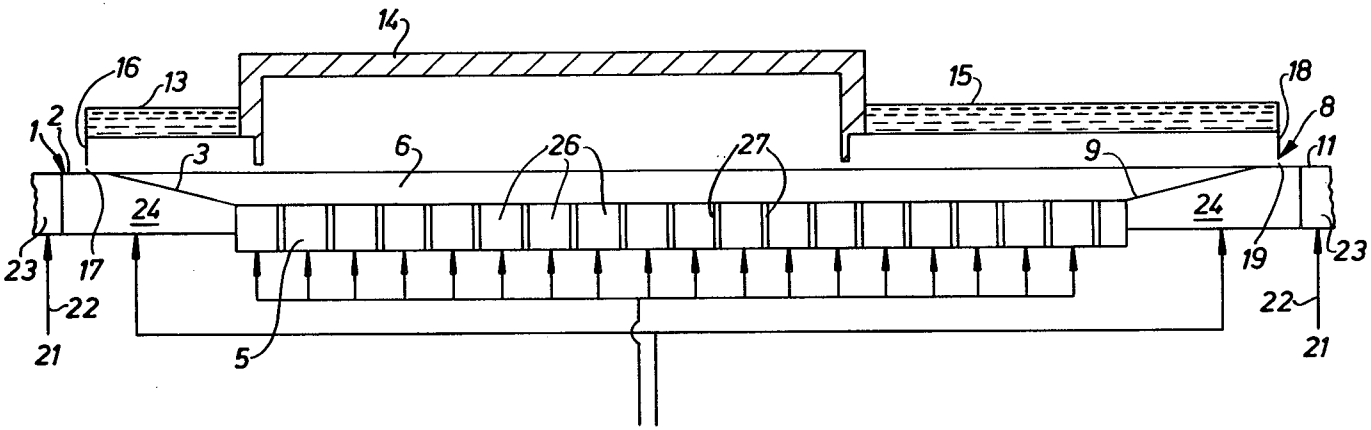
FIG. 1 is a side elevation in section of a furnace in accordance with the invention.

As will be seen from FIG. 1 the furnace comprises a water-cooled entry zone 13, a central refractory lined heating zone 14 and a water-cooled exit cooling zone 15. The shells for zones 13 and 15 may be constructed from steel.

Located at the forward end of the furnace zone 13 is an entry lip seal 16. The seal 16 is located above the leading portion 2 of the entry table 1 and is spaced from the table surface to define an elongate shallow slot 17 of sufficient depth to enable metallic strip 'S' to enter the furnace. An exit seal 18 is located at the end of the furnace zone 15 about the trailing portion 11 of the exit table 8 and defines with the table surface a shallow elongate slot 19.

Gas under pressure is supplied from a source 21 via ducting 22 to compartments 23 in communication with the orifices formed respectively in those parts of the portions 2 and 11 of the tables 1 and 8 upstream and downstream respectively of the seals 16 and 18. The gas may comprise air or nitrogen. Adjacent the compartments 23 are further compartments 24 which are covered by those parts of the table portions 2 and 11 in proximity to the seals 16 and 18 and the inclined table portions 3, 9. The compartments 24 are supplied with inert gas (e.g. nitrogen) under pressure from a source 25.

Figure 4:
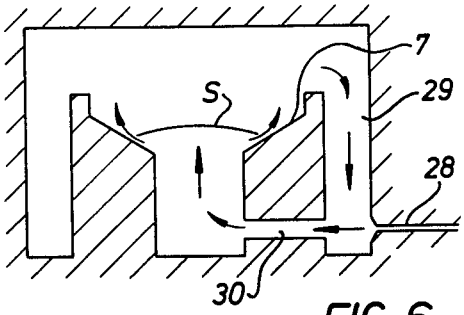
FIG. 4 is a section taken along line IV—IV of FIG. 2.

As will be seen from FIG. 1, the trough 6 of the heating zone 14 is divided into a number of separate compartments 26 by upstanding walls 27 and each compartment 26 is supplied with gas under pressure through injector passages 28 (FIG. 4). The gas emerging from the injectors 28 induces gases already present within the furnace to recirculate via a side passage 29 and passages 30 into the individual compartments 26 of the trough 6. Gas within the trough 6 passes upwardly towards the under surface of the strip 'S' and leaves the trough between the side edges of the strip and the opposed surfaces of the inclined side walls 7 of the trough. The strip 'S' is, therefore, supported above the inclined walls of the trough by the recirculating gas which, in effect, forms a continuous gas cushion on which the strip floats. The gas supplied to the heating zone 14 may consist of a reducing gas and its rate of supply is controlled in dependence of the rate at which gas leaks from the furnace via the slots 17, 19.

Figure 2:
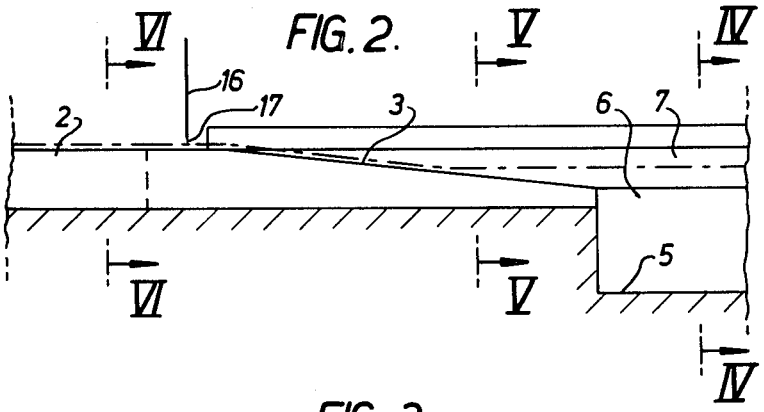
FIG. 2 is a side elevational view in section of the entry floatation table of the furnace illustrated in FIG. 1.
Figure 5:
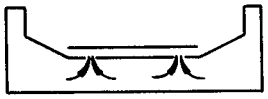
FIG. 5 is a section taken along line V—V of FIG. 2.
Figure 6:
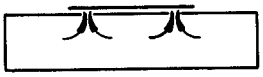
FIG. 6 is a section taken along line VI—VI of FIG. 2.

In operation of the furnace, the strip 'S' enters the cooled entry zone 13 through the slot 17 provided between the seal 16 and the table 1. The path taken by the strip as it passes through the furnace is shown in broken line in FIG. 2. The strip is supported above the table by means of gas jets issuing from the orifices 4; as shown in FIGS. 5 and 6, since the pressure distribution below the strip is substantially constant across its width, the strip adopts a substantially flat attitude above the table. Thus the depth of the slot 17 need be only just greater than the thickness of the strip; the width of the slot, however, may be such that various strip widths may be introduced into the furnace without consequent excessive gas losses from the furnace. After passing through the seal 16 the strip is conveyed downwardly by the inclined portion 3 of the table into the trough 6. The strip floats along the trough at a height dependent upon its width and upon the pressure of the gases upon which it is supported. The inclined walls 7 of the trough permit strips of different width to be treated within the furnace. As illustrated in FIG. 4, the strip adopts a bowed attitude in cross-section as it passes along the trough 6 due to the uneven pressure distribution across its under surface. The strip leaves the trough 6 along the upwardly inclined portion 9 of the exit floatation table 8 and passes out from the furnace through the slot 19 defined between the exit table 8 and the seal 18. As for the entry table 1 the strip adopts a substantially flat attitude as it passes over the table 8 thus enabling the depth of the slot 19 to be minimal.

Previously, heat treatment furnaces within which strip is supported on a gas cushion have been provided with a continuous trough throughout their length. Thus, the slots provided at the entry and exit seals have needed to be sufficiently deep to permit passage of the strip in its bowed configuration. By employing floatation or jet tables at entry to an exit from the furnace, the arrangement described above permits the strip to enter and leave the furnace in a generally flat attitude, thus minimising the depth of the entry and exit slots required and reducing leakage of gas from the furnace. Consequently, the amount of pressurized gas required to be supplied to the furnace is also reduced. Furthermore, the arrangement provides a furnace in which strips of different width can be treated with minimal gas losses from the furnace.

Figure 7:
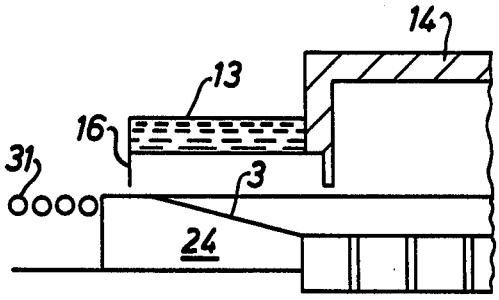
FIG. 7 is a side elevational view in section of the entry portion of a furnace in accordance with the invention incorporating an alternative entry table.

In the embodiment of the invention illustrated in FIG. 7 the jet table 1 at entry to the furnace is replaced by a conventional roller table 31 comprising a number of adjacent rollers which are free to rotate about axes perpendicular to the direction of travel of strip to the furnace. In such an arrangement the strip again adopts a generally flat attitude as it passes over the surface of the table, thus permitting a minimal spacing between the entry seal and the surface of the table. In a further arrangement the jet table 8 is replaced by a roller table. In a still further embodiment roller tables may be located at entry and exit from the furnace.

Figure 8:
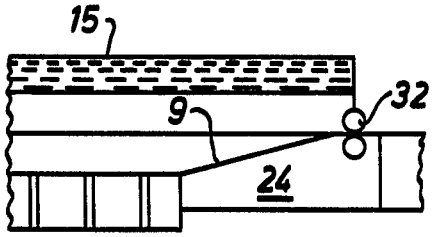
FIG. 8 is a side elevational view in section of the exit portion of a furnace in accordance with the invention incorporating an alternative exit seal.

In the arrangement illustrated in FIG. 8, the exit lip seal 18 illustrated in FIG. 1 is replaced by a roller seal 32.

We claim:

1. A furnace for continuously heat treating metallic strip comprising an entry table including a leading portion having a substantially plane upper surface and a trailing portion which inclines downwardly towards the base of a floatation trough, the trough extending along substantially the full length of the heating zone of the furnace and including upwardly and outwardly inclined side walls, the furnace also comprising flow restricting means located above the upper surface of the leading portion of the entry table to define with the table surface a shallow slot sufficient to enable strip to enter the furnace.

2. A furnace as claimed in claim 1 wherein the entry table comprises a floatation table having an upper surface provided with a plurality of orifices for discharging gas under pressure upwardly towards the under surface of the strip as it passes over the table.

3. A furnace as claimed in claim 1 wherein the entry table comprises a roller table which includes a plurality of adjacent rollers which rotate about horizontal axes perpendicular to the direction of travel of the strip over the table.

4. A furnace for continuously heat treating metallic strip comprising an entry floatation table having an upper surface provided with a plurality of orifices for discharging gas under pressure upwardly towards the under surface of the strip as it passes over the table and including a leading portion having a substantially plane upper surface and a trailing portion which inclines downwardly towards the base of a floatation trough extending along substantially the full length of the heating zone of the furnace and including upwardly and outwardly inclined side walls, the furnace also comprising flow restricting means located above the upper surface of the leading portion of the entry floatation table and defining with the table surface a shallow slot sufficient to enable strip to enter the furnace.

5. A furnace as claimed in claim 4 further comprising an exit floatation table having an upper surface provided with orifices for discharging gas under pressure upwardly towards the under surface of the strip as it passes over the table and including a leading portion which inclines upwardly from the base of the trough and merges with a trailing portion of the table having a substantially plane upper surface.

6. A furnace as claimed in claim 1 wherein the flow restricting means comprises lip seals located one at entry to and one at exit from the furnace.

7. A furnace as claimed in claim 1 wherein the flow restricting means located at exit from the furnace comprises a roller seal.

8. A furnace as claimed in claim 1 wherein the floatation trough is divided into a plurality of separable open topped compartments into each of which gas is supplied via an injector.

9. A furnace as claimed in claim 8 wherein the gas supplied to the trough consists of a reducing gas.

* * * * *